US010196232B2

(12) United States Patent
Khubani

(10) Patent No.: US 10,196,232 B2
(45) Date of Patent: Feb. 5, 2019

(54) HOSE ASSEMBLY

(71) Applicant: Telebrands Corp., Fairfield, NJ (US)

(72) Inventor: Ajit Khubani, Saddle River, NJ (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 15/872,401

(22) Filed: Jan. 16, 2018

(65) Prior Publication Data

US 2018/0201470 A1 Jul. 19, 2018

Related U.S. Application Data

(60) Provisional application No. 62/446,777, filed on Jan. 16, 2017.

(51) Int. Cl.

| | |
|---|---|
| ***B65H 75/28*** | (2006.01) |
| ***B65H 75/40*** | (2006.01) |
| ***B65H 75/44*** | (2006.01) |

(52) U.S. Cl.

CPC ..... *B65H 75/40* (2013.01); *B65H 75/285* (2013.01); *B65H 75/446* (2013.01); *B65H 75/4478* (2013.01); *B65H 75/4492* (2013.01); *B65H 2701/33* (2013.01)

(58) Field of Classification Search

CPC ..... B65H 75/14; B65H 75/28; B65H 75/40; B65H 75/406; B65H 75/4471; B65H 75/4494; B65H 75/4478; B65H 2402/412; B65H 2701/332

See application file for complete search history.

(56) References Cited

U.S. PATENT DOCUMENTS

| | | | | |
|---|---|---|---|---|
| 3,520,487 A * | 7/1970 | Quenot | G01B 3/1005 | 242/395.1 |
| 3,587,266 A | 6/1971 | Cowley | | |
| 3,587,626 A * | 6/1971 | Cowley | B65H 75/403 | 137/355.12 |
| 4,143,746 A * | 3/1979 | Lowery | H02G 11/02 | 191/12.4 |
| 4,862,636 A * | 9/1989 | Doskocil | A01K 91/18 | 242/402 |
| 5,014,925 A * | 5/1991 | Cump | B65H 75/406 | 242/405.3 |
| D359,440 S * | 6/1995 | Stewart | D8/358 | |
| 5,720,055 A * | 2/1998 | Krist | D06F 41/00 | 4/255.06 |

(Continued)

OTHER PUBLICATIONS

Bayco KW-110 Cord Storage Reel with Center Spin Handle, 100-Feet, available at www.amazon.com, accessed Jan. 25, 2017.

(Continued)

*Primary Examiner* — William A. Rivera
(74) *Attorney, Agent, or Firm* — Cooper & Dunham, LLP

(57) ABSTRACT

A hose storage device including an open cylindrical core having an outer circumference and an inner circumference, the inner circumference including an inner track, a first wall and a second wall coupled to the open cylindrical core, the outer circumference of the open cylindrical core, the first wall, and the second wall defining a hose storage portion configured to receive a hose, a rotating ring operatively coupled to the inner track, and a handle pivotably coupled to the second wall, the handle configured to pivot between an operative position and a storage position.

17 Claims, 14 Drawing Sheets

(56) References Cited

U.S. PATENT DOCUMENTS

| | | | | |
|---|---|---|---|---|
| 2007/0029431 | A1* | 2/2007 | Lai | B65H 75/22 242/395 |
| 2007/0176045 | A1* | 8/2007 | Chen | B65H 75/14 242/614 |
| 2007/0257146 | A1* | 11/2007 | Fleming | B65H 75/14 242/405.3 |
| 2008/0017745 | A1* | 1/2008 | Laga | B65H 75/406 242/395 |
| 2015/0166300 | A1* | 6/2015 | Soto | B65H 75/14 242/395.1 |

OTHER PUBLICATIONS

International Search Report PCT/US2018/13835, published Apr. 24, 2018.
Written Opinion of International Search Authority PCT/US2018/13835, published Apr. 24, 2018.

* cited by examiner

100

HOSE ASSEMBLY

CROSS-REFERENCE TO PRIOR APPLICATIONS

This application claims priority to U.S. Provisional Application Ser. No. 62/446,777, filed on Jan. 16, 2017, which is hereby incorporated by reference herein in its entirety.

BACKGROUND

A water hose is a common accessory which can become burdensome, difficult to store, unreliable, and bulky. Water hoses can be unreliable as they can kink, be punctured, leak and tear. There exists many types of water hoses and assemblies to store water hoses. However, these storage devices are typically bulky and difficult to use. These storage devices may include reels on which the water hoses are stored. These reels can be bulky, and make it difficult to wind and unwind the water hose. Reels also often require large areas for storage and can further require lots of manual labor to wind and unwind the water hose. Moreover, many reels do not allow for a water hose to be easily secured within the reel to facilitate winding and unwinding of the hose for easy storage.

SUMMARY

Embodiments of the present invention can provide a hose storage device including an open cylindrical core having an outer circumference and an inner circumference, the inner circumference including an inner track, a first wall and a second wall coupled to the open cylindrical core, the outer circumference of the open cylindrical core, the first wall, and the second wall defining a hose storage portion configured to receive a hose, a rotating ring operatively coupled to the inner track, and a handle pivotably coupled to the second wall, the handle may be configured to pivot between an operative position and a storage position.

According to certain embodiments, the rotating ring may be operatively coupled to the inner track to rotatably move along the inner track relative to the inner circumference. Further, the first wall and second wall can include feet.

According to certain embodiments, the handle may be coupled to the second wall via hinge. The handle may be configured to releasably lock in the operative position and the storage position. In the storage position, an end of the handle may be flush with an exterior surface of the second wall. In the operative position, the handle may protrude from an exterior surface of the second wall. Further, the handle may be disposed adjacent to an outer circumference of the second wall.

According to certain embodiments, the hose storage device may include a retention mechanism configured to receive and releasably secure an end portion of a hose. The retention mechanism may include a protrusion extending from the first wall or the second wall.

Another embodiment of the present invention can provide a hose assembly including a hose, and a hose storage device having an open cylindrical core having an outer circumference and an inner circumference, the inner circumference including an inner track, a retention mechanism configured to receive and releasably secure an end portion of the hose to the outer circumference of the open cylindrical core, a rotating ring operatively coupled to the inner track configured to rotatably move along the inner track relative to the inner circumference, and a handle pivotably coupled to the hose storage device, the handle configured to pivot between an operative position and a storage position.

According to certain embodiments, a length of the hose may include a flexible metal. Further, the hose storage device may include feet.

According to certain aspects, the handle may be coupled to the hose storage device via hinge. The handle may be configured to releasably lock in the operative position and the storage position. In the storage position, an end of the handle may be flush with an exterior surface of the hose storage device. In the operative position, the handle may protrude from an exterior surface of the hose storage device. Further, the handle may be disposed adjacent to an outer circumference of the hose storage device.

According to certain embodiments, the retention member may include a protrusion extending from the hose storage device.

BRIEF DESCRIPTION OF THE DRAWINGS

The features and advantages of the present invention can be more readily understood from the following detailed description with reference to the accompanying drawings, wherein.

DETAILED DESCRIPTION

Exemplary embodiments of the present invention can provide a new and novel water hose assembly. The exemplary water hose assembly can provide allow easy and convenient storage of a water hose. An embodiment of the exemplary hose assembly is shown in FIGS. 1-14. As shown in FIGS. 1-14, exemplary hose assembly 100 can include a water hose 106 and a storage reel 102. Exemplary hose assembly 100 can provide a portable, tidy, easy to use, easy to store and durable water hose for interior and exterior use. For example, the exemplary assembly can allow a user to easily transport a water hose neatly stored in the reel to any desired location and allow the user to easily unwind the hose for use and wind the hose back onto the reel for storing and/or transporting the hose, as necessary.

Figure 13:
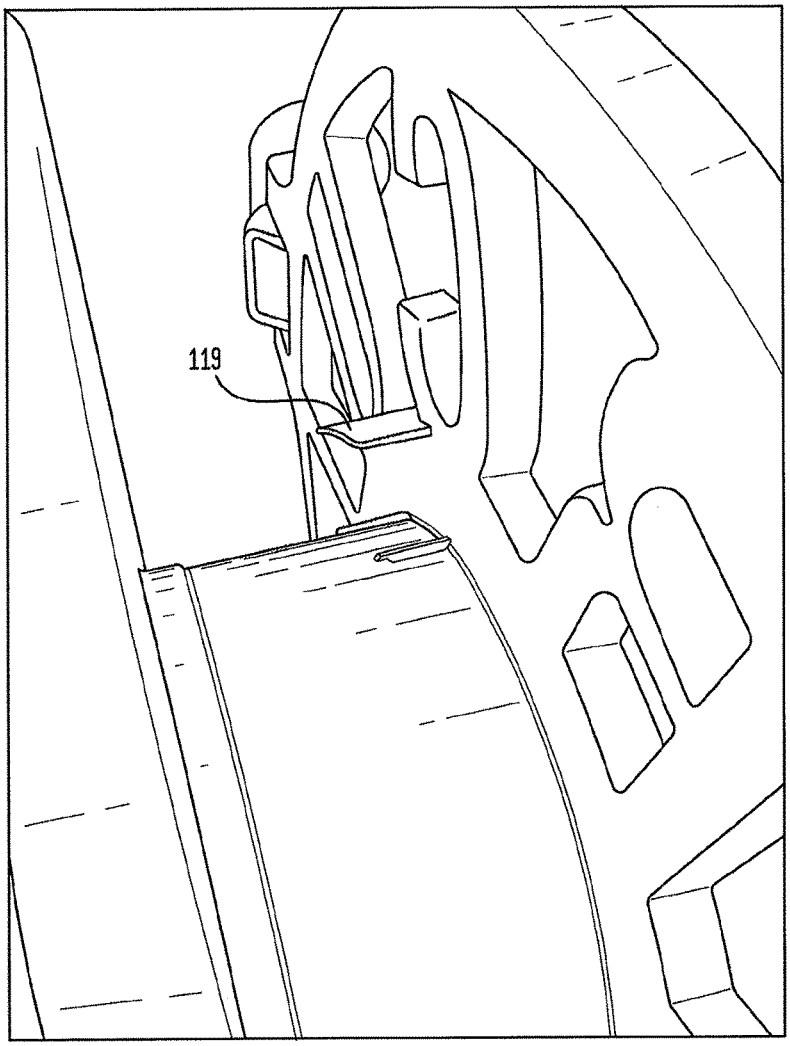
FIG. 13 is an illustration of an exemplary retention mechanism according to one embodiment of the present invention.
Figure 14:
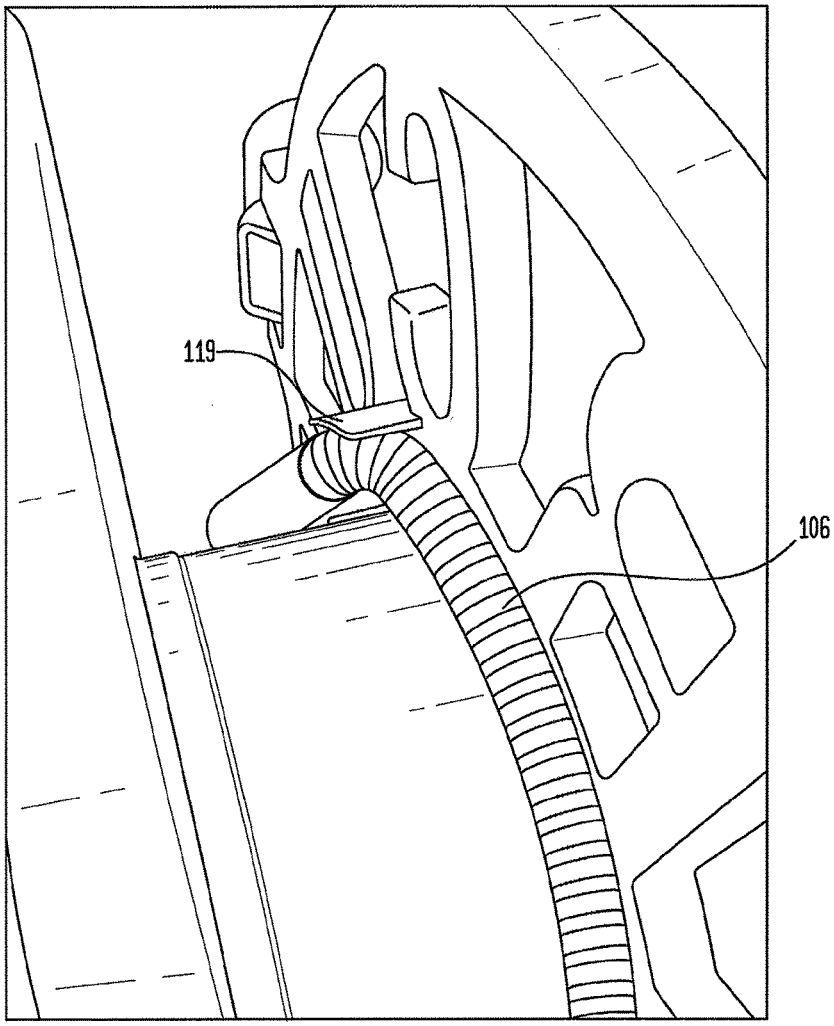
FIG. 14 is an illustration of an exemplary retention mechanism according to one embodiment of the present invention.

As shown in FIGS. 1-14, exemplary hose assembly 100 can include reel 102, hose 106, rotating ring 104, and handle 110. Accordingly, hose 106 can be wrapped around reel 102 to conveniently support and store hose 106. In one embodiment of the present invention, hose 106 may be wound around reel 102 for storage of hose 106. As shown in the Figures, reel 102 may include an open cylindrical core 120, first wall 201, and second wall 203. First wall 201 and second wall 203 may be coupled to open cylindrical core 120. Open cylindrical core 120 can include outer circumference 207 and inner circumference 205. Outer circumference 207, first wall 201, and second wall 203 may define a hose storage portion (i.e., compartment, section, pocket, area etc.), for storage of hose 106. In storage, hose 106 can be wrapped around open cylindrical core 120, and first wall 201 and second wall 203 can be coupled to open cylindrical core 120 to support and secure hose 106 when it is wrapped around open cylindrical core 120. Optionally, reel 102 may include retention mechanism 119 to retain one end of hose 106 to facilitate wrapping hose 106 around reel 102. For example, retention mechanism 119 can include a clip, a connector, an elastic band, etc. As shown in FIGS. 13 and 14, retention mechanism 119 may include a protrusion which can define a recess configured to receive and secure hose 106 to releasably secure hose 106 to reel 102 adjacent outer circumference 207 of open cylindrical core 120. According to one embodiment, the protrusion of retention mechanism 119 may protrude from second wall 203 of reel 102 towards first wall 201. In a preferred embodiment of the present invention shown in FIG. 14, hose 106 may be securely coupled to reel 102 via retention mechanism 119 to facilitate wrapping of hose 106 around reel 102. In one embodiment of the present invention, reel 102 may be circular. However, reel 102 may be any shape desired, such as square, triangular, octagonal, etc. Reel 102 may be made out of plastic. However, reel 102 may be made out of any other material capable of supporting hose 106, such as, for example, plastic, wood, metal, or any other type of material capable of supporting hose 106. Rotating ring 104 and handle 110 can facilitate winding and unwinding of hose 106 onto and off of reel 102.

As shown in FIG. 2, and 4-6, hose 106 may be a flexible hose having connectors at both end which can be coupled to a fluid source on a first end and can receive hose accessories (e.g., nozzle, spray gun, sprinkler, etc.) on the other end (i.e., at terminal end 108), and hose 106 can provide a conduit for the fluid to flow from the fluid source to terminal end 108 of hose 106. For example, hose 106 can include standard threaded connectors to mate with a water faucet. Alternatively, hose 106 can include other types of connectors (e.g., snap-fit, pressure fit, etc.) to mate with other types of connections and accessories. As shown in FIGS. 1-10, terminal end 108 can include connector 109. Terminal end 108 may be reinforced to prevent damage to terminal end 108 during connecting and disconnecting of terminal end 108 from a fluid source. According to certain exemplary embodiments, hose 106 may be made of a flexible metal, which can, for example, provide a durable water hose that may also prevent hose 106 from kinking, being punctured, etc. However, hose 106 may be made of any type of material such as rubber, polymer, or any other type of material.

Figure 1:
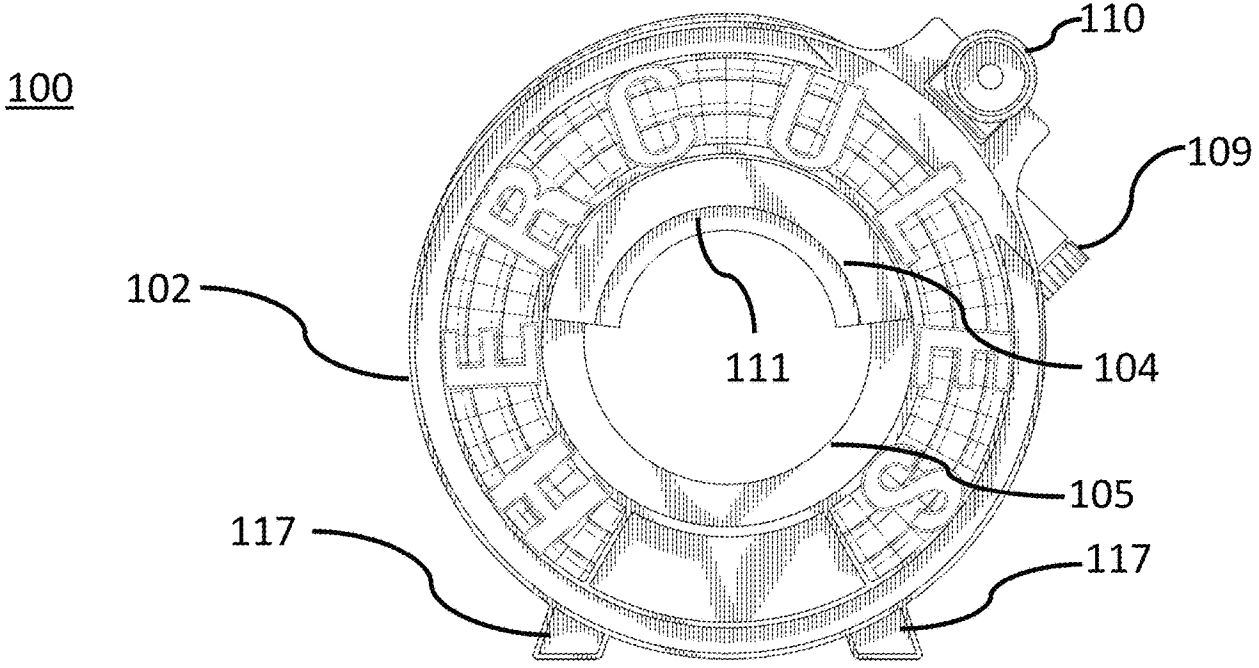
FIG. 1 is an illustration of an exemplary hose assembly according to one embodiment of the present invention.
Figure 2:
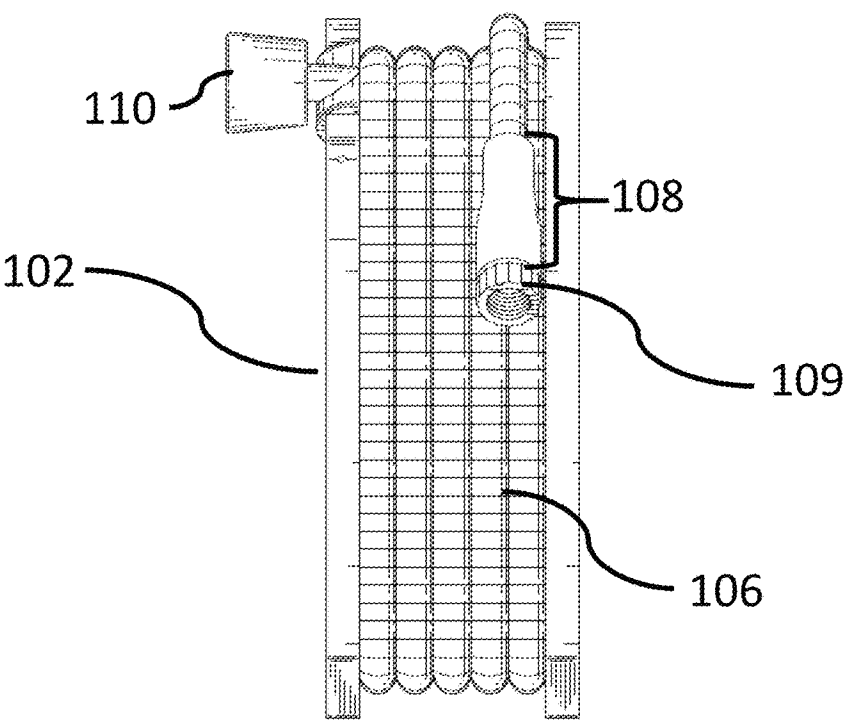
FIG. 2 is an illustration of an exemplary hose assembly according to one embodiment of the present invention.
Figure 3:
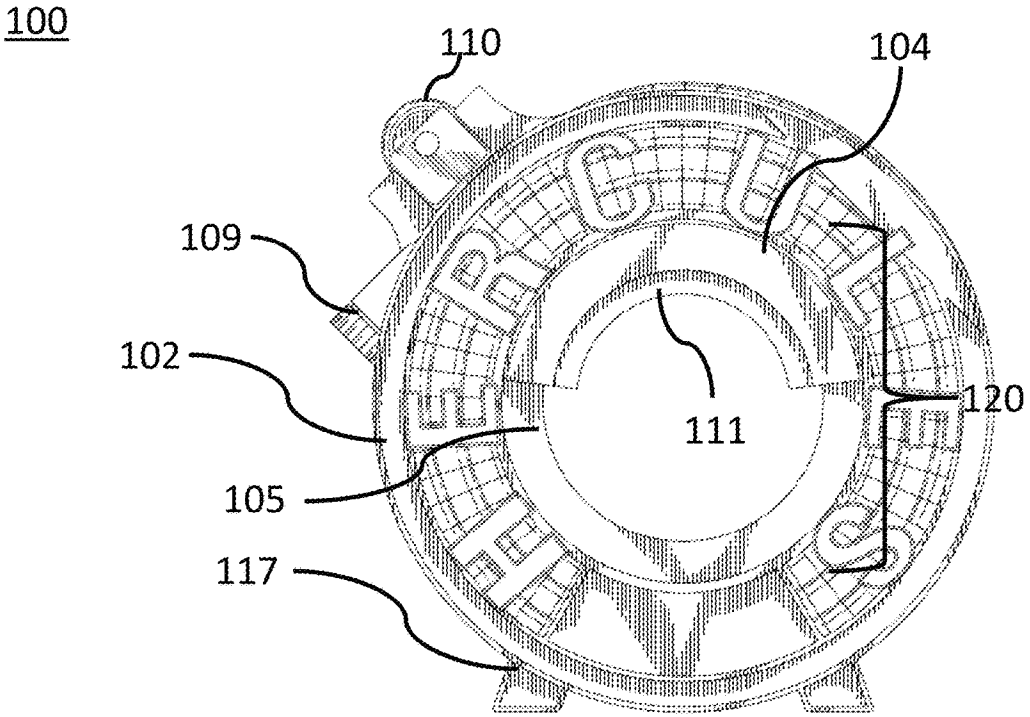
FIG. 3 is an illustration of an exemplary hose assembly according to one embodiment of the present invention.
Figure 4:
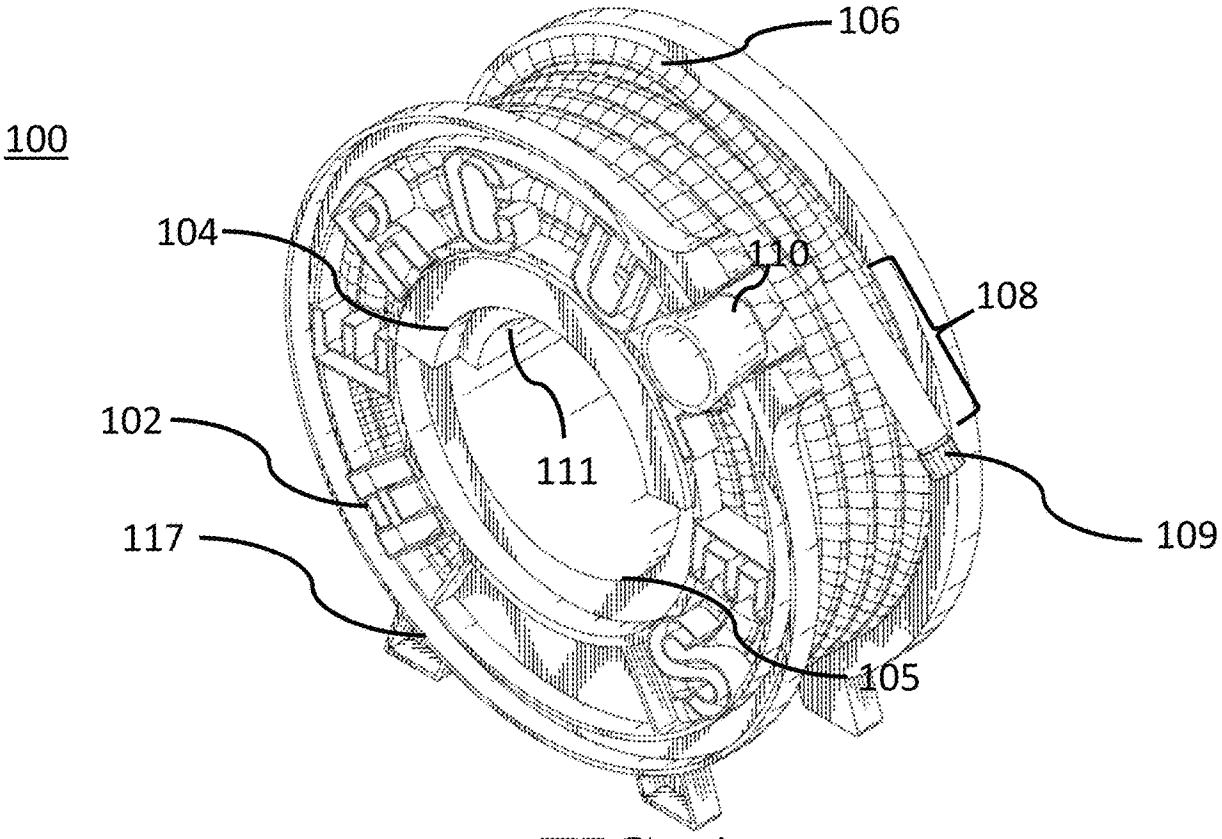
FIG. 4 is an illustration of an exemplary hose assembly according to one embodiment of the present invention.
Figure 5:
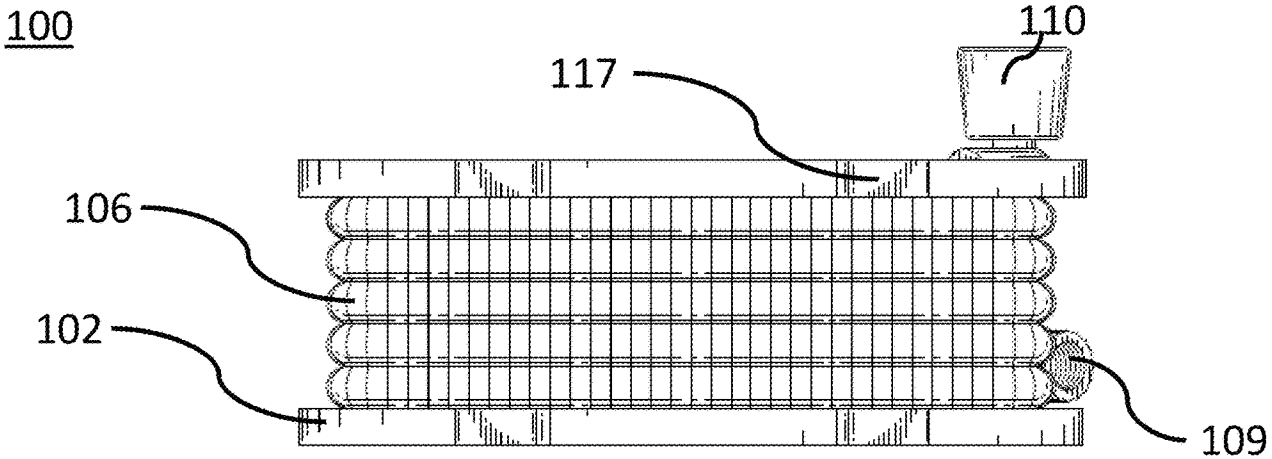
FIG. 5 is an illustration of an exemplary hose assembly according to one embodiment of the present invention.
Figure 6:
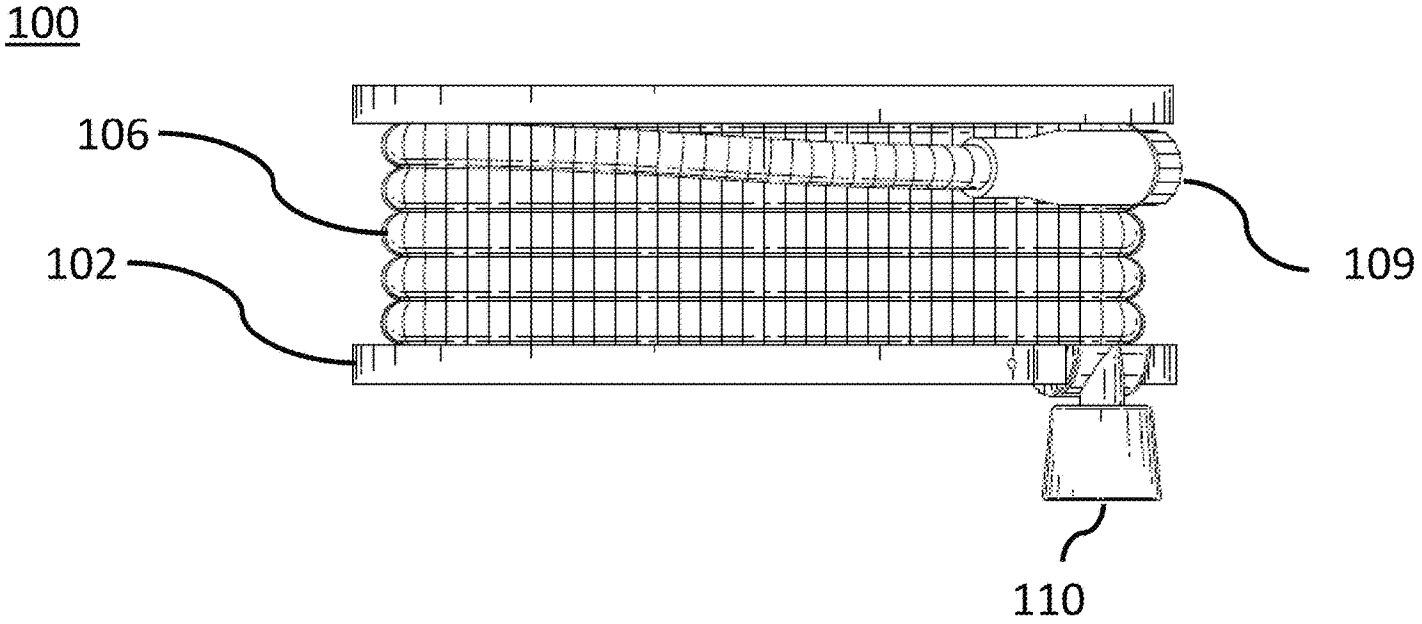
FIG. 6 is an illustration of an exemplary hose assembly according to one embodiment of the present invention.
Figure 7:
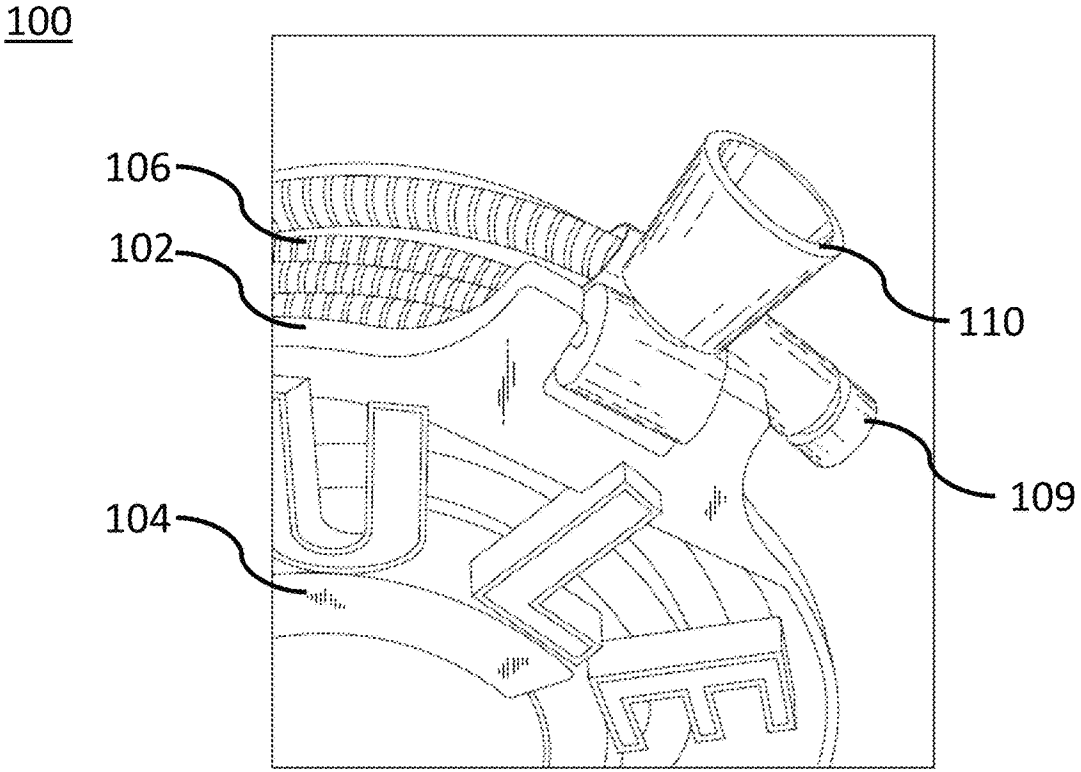
FIG. 7 is an illustration of an exemplary hose assembly according to one embodiment of the present invention.
Figure 8:
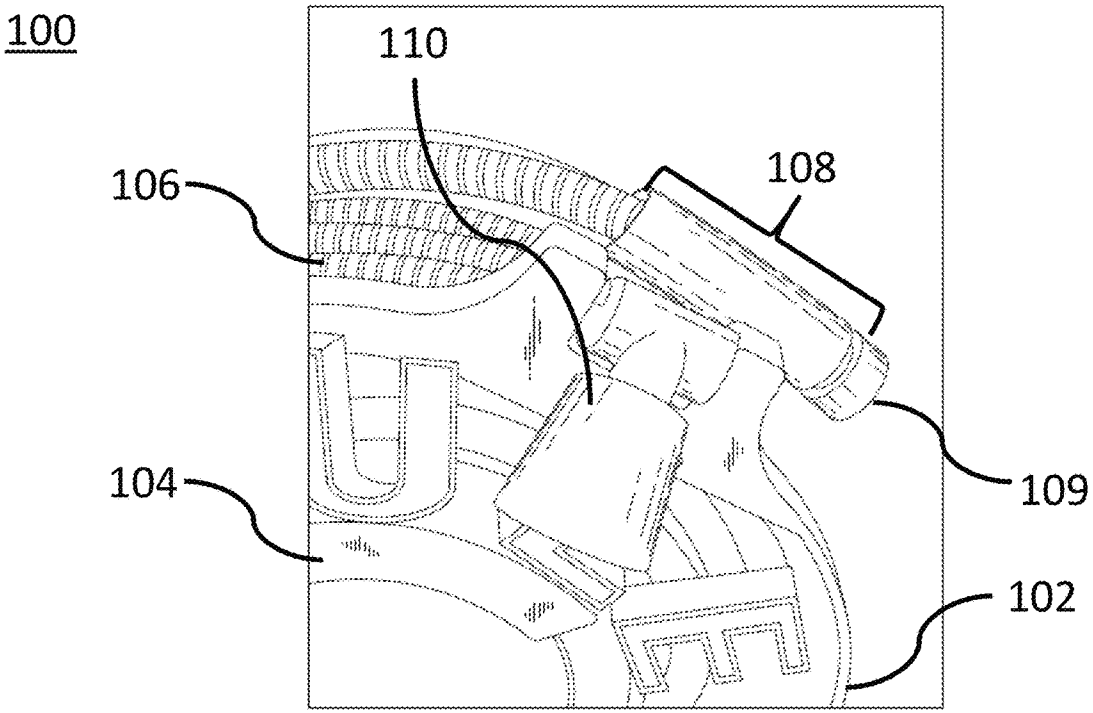
FIG. 8 is an illustration of an exemplary hose assembly according to one embodiment of the present invention.
Figure 9:
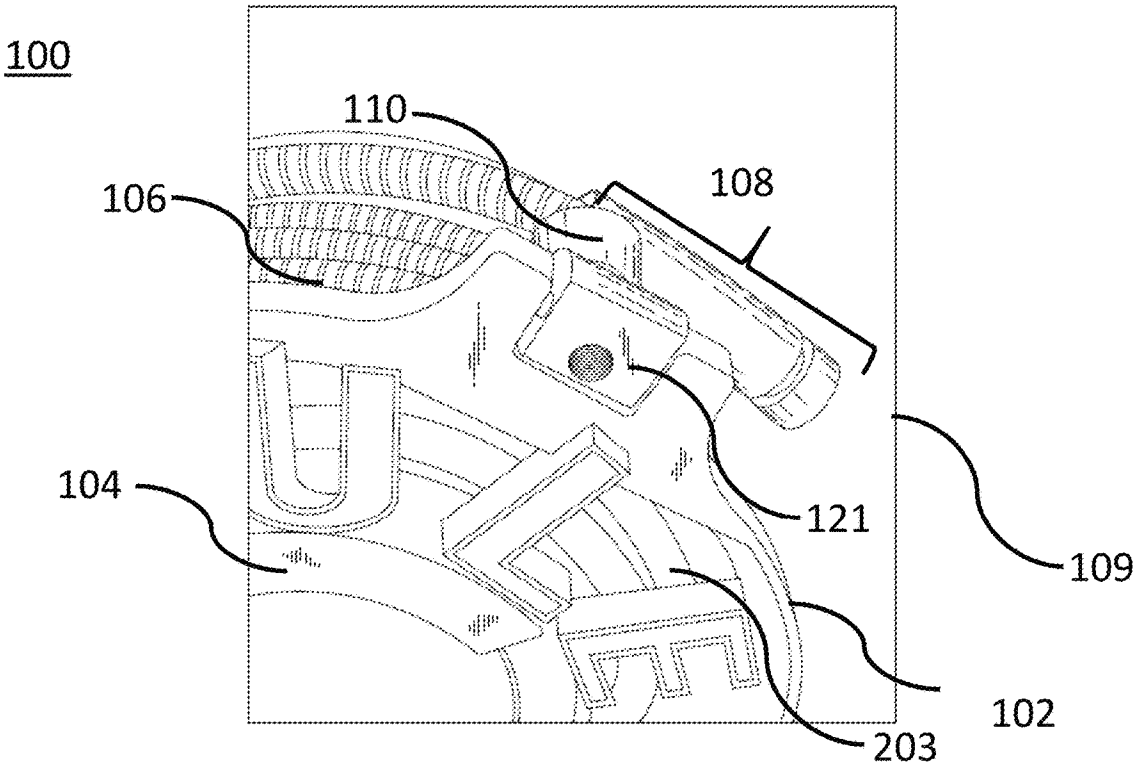
FIG. 9 is an illustration of an exemplary hose assembly according to one embodiment of the present invention.
Figure 10:
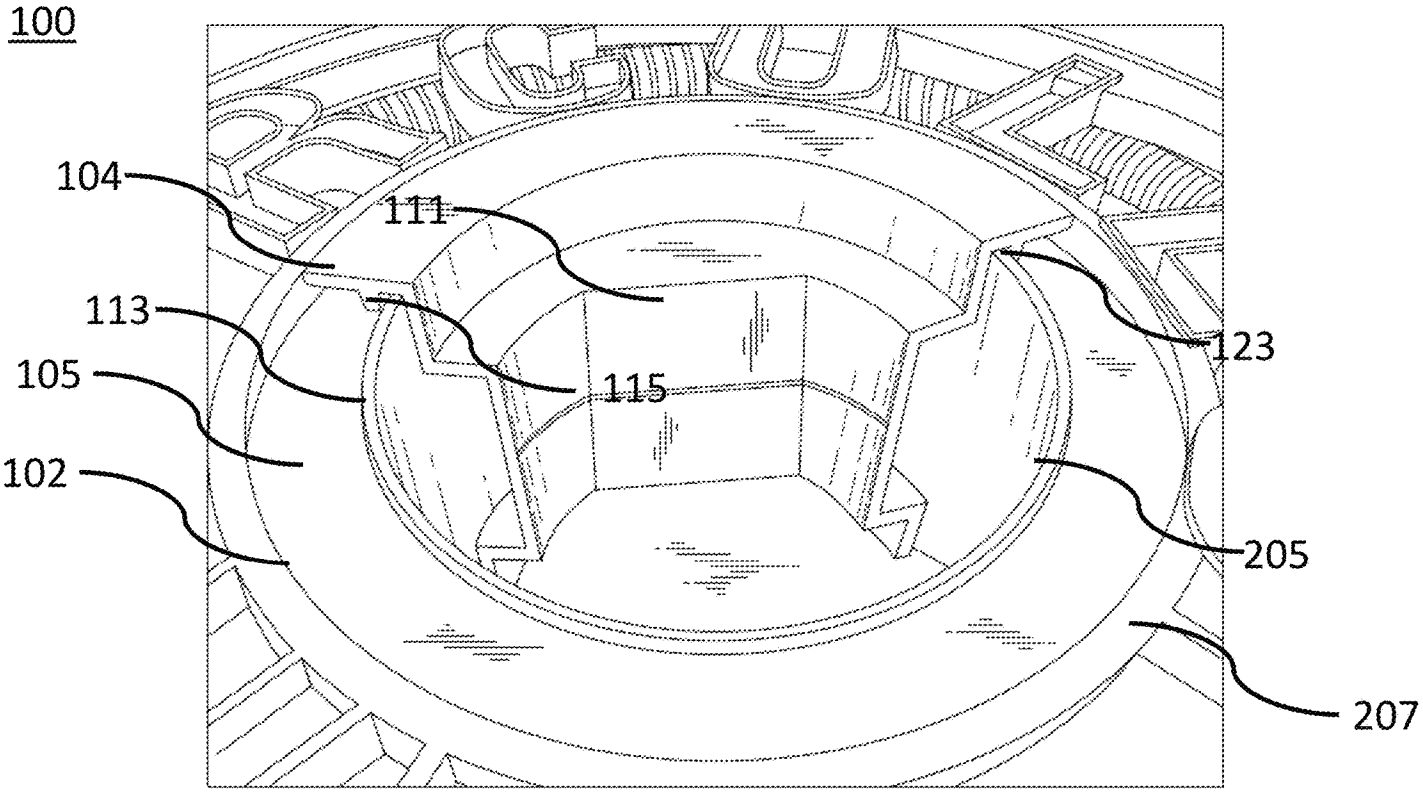
FIG. 10 is an illustration of an exemplary hose assembly according to one embodiment of the present invention.
Figure 11:
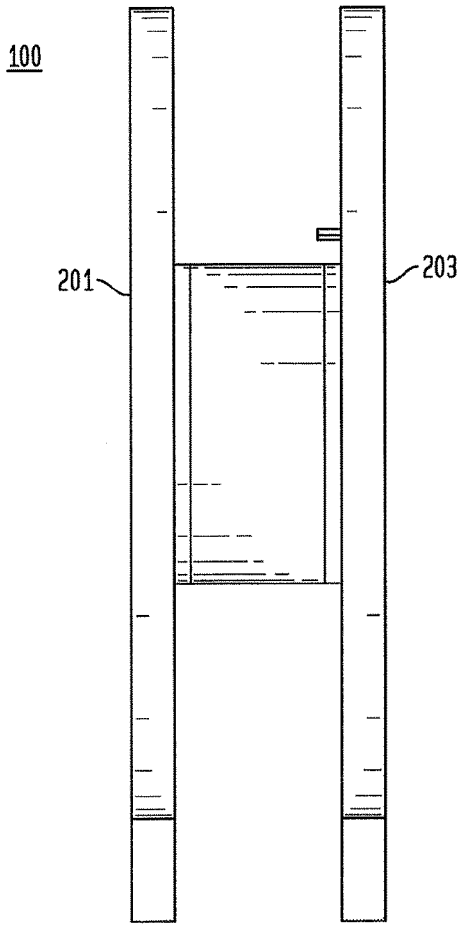
FIG. 11 is an illustration of an exemplary hose assembly according to one embodiment of the present invention.
Figure 12:
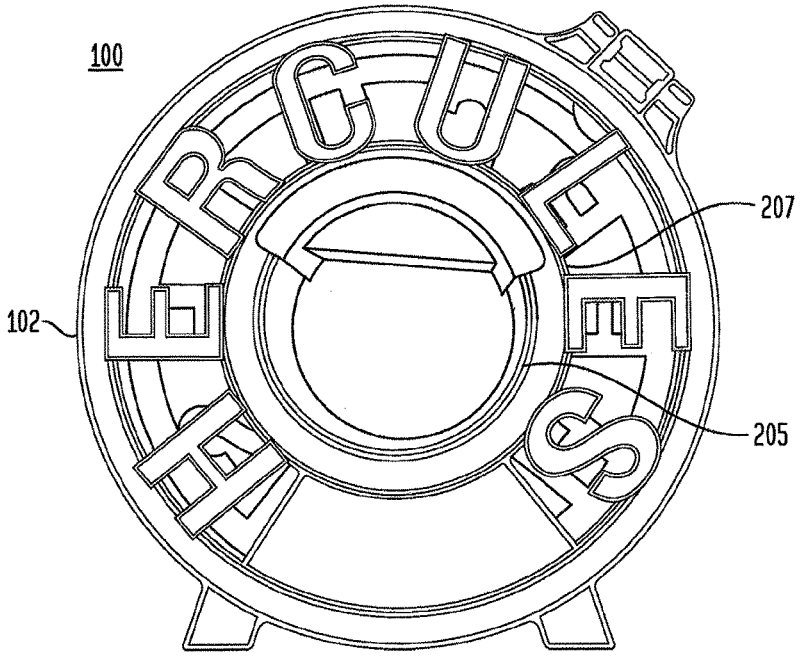
FIG. 12 is an illustration of an exemplary hose assembly according to one embodiment of the present invention.

As shown in FIGS. 1-9, handle 110 may be coupled to reel 102 and can facilitate rotation of reel 102 to enable winding and unwinding of hose 106 onto and off of reel 102. Handle 110 may be disposed adjacent to and pivotally coupled to the outer circumference of second wall 203 of reel 102 via a hinge such that handle 110 can rotate, for example, between an operative position and a storage position. However, handle 110 may be coupled to any part of reel 102, such as first wall 201, open cylindrical core 120, or any other part of hose assembly 100. In the operative position, handle 110 may pivot to an exterior surface of reel 102 allowing a user to easily grasp handle 110 to facilitate rotating reel 102. The operative position of handle 110 is shown, for example, in FIGS. 5 and 6. In the storage position, handle 110 may pivot to the interior of reel 102 such that handle 110 is not protruding beyond an exterior surface of reel 102, thereby allowing hose assembly 100 to be easily stored or packaged. For example, as seen in FIG. 9, in the storage position, end 121 of handle 110 may be flush with the exterior surface of reel 102 such that handle 110 does not protrude beyond the face of second wall 203 to facilitate, for example, easy storage of reel 102. Further, handle 110 can include releasably locking mechanism that can allow handle 110 to be releasably locked in certain positions (e.g., the operative position, the storage position, or any other position). For example, handle 110 may include a snap-fit locking mechanism allowing handle 110 to remain in an operative position or a storage position. Alternatively, handle 110 can include other types of locking mechanisms (e.g., magnets, pressure fit, etc.) to allow handle 110 to remain in an operative position or a storage position.

According to embodiments of the present invention, exemplary hose assembly 100 may include inner rotating ring 104. As shown in FIGS. 1-12, inner circumference 205 of reel 102 can include inner track 105, and inner rotating ring 104 may be operatively coupled to inner track 105 of reel 102. Inner track 105 may include track lip 113 and inner rotating ring 104 may include protrusion 115 creating recessed portion 123. Recessed portion 123 of inner rotating ring 104 may cooperatively engage track lip 113 of inner track 105 to rotatably couple to inner rotating ring 104, thereby allowing inner rotating ring 104 to rotate around inner track 105. In practice, inner rotating ring 104 may include mounting elements to allow reel 102 to be mounted to a surface (e.g., a wall, etc.) and allow reel 102 to rotate relative to inner rotating ring 104. Alternatively, inner rotating ring 104 can be configured to be held by a user to allow reel 102 to rotate relative to inner rotating ring 104. For example, inner rotating ring 104 may remain stationary as reel 102 rotates relative to inner rotating ring 104 while the user holds inner rotating ring 104. In one embodiment of the present invention, inner rotating ring 104 may include protruding portion 111. Protruding portion 111 may be configured to allow user to grip inner rotating ring 104 as reel 102 rotates about inner rotating ring 104.

In another embodiment of the present invention, reel 102 may include a fluid source connector which can provide a connection to a fluid source and provide fluid communication from the fluid source to hose 106. For example, the fluid source connector of reel 102 can include a connector to mate with a fluid source, a second connector to mate with a connector of hose 106, and a conduit to provide fluid communication between the fluid source and hose 106. Accordingly, fluid from the fluid source may flow through the source connector of reel 102 to and through hose 106. The source connector of reel 102 can serve a secondary purpose of retaining hose 106 to reel 102 via the second connector configured to mate with a connector of hose 106.

In one embodiment of the present invention, reel 102 may include feet 117 for standing reel 102 upright. Feet 117 of reel 102 may be located at the bottom of reel 102 to allow reel 102 to stand upright during storage. For example, feet 117 may be located on first wall 201 and second wall 203 of reel 102. However, feet 117 of reel 102 may be located anywhere on reel 102. For example, feet 117 may be located on the top or side of reel 102. In another embodiment, reel 102 may include removable mounts for storing reel 102 upright. In yet another embodiment of the present invention, reel 102 may include mounts on reel 102 for securing reel 102 to a surface such as a wall.

According to one embodiment of the present invention, reel 102 may include storage for accessories to be used with hose 106. For example, reel 102 may include storage for hose accessories such as a spray adapter, sprinkler, etc. to be used with hose 106. Further, reel 102 may be configured to allow automatic recoiling of hose 106 around reel 102. For example, reel 102 may include a mechanism for allowing hose 106 to automatically wind around reel 102.

The embodiments and examples shown above are illustrative, and many variations can be introduced to them without departing from the spirit of the disclosure. For example, elements and/or features of different illustrative and exemplary embodiments herein may be combined with each other and/or substituted with each other within the scope of the disclosure. For a better understanding of the disclosure, reference should be had to any accompanying drawings and descriptive matter in which there is illustrated exemplary embodiments of the present invention.

The invention claimed is:

1. A hose storage device, comprising:

an open cylindrical core having an outer circumference and an inner circumference, the inner circumference including an inner track;

a first wall and a second wall coupled to the open cylindrical core, the outer circumference of the open cylindrical core, the first wall, and the second wall defining a hose storage portion configured to receive a hose;

a rotating ring operatively coupled to the inner track; and a handle pivotably coupled to the second wall and disposed between two protrusions extending from an outer circumference of the second wall and along a same plane of the second wall, the handle configured to pivot between an operative position and a storage position, wherein in the storage position, an end of the handle is flush with an exterior surface of the second wall such that the handle does not protrude beyond the exterior surface of the second wall.

2. The hose storage device of claim 1, wherein the rotating ring is operatively coupled to the inner track to rotatably move along the inner track relative to the inner circumference.

3. The hose storage device of claim 1, wherein the first wall and second wall include feet.

4. The hose storage device of claim 1, wherein the handle is coupled to the second wall via a hinge.

5. The hose storage device of claim 1, further comprising a retention mechanism configured to receive and releasably secure an end portion of a hose.

6. The hose storage device of claim 5, wherein the retention mechanism includes a protrusion extending from the first wall or the second wall.

7. The hose storage device of claim 1, wherein the handle is configured to releasably lock in the operative position and the storage position.

8. The hose storage device of claim 1, wherein the handle is disposed adjacent to an outer circumference of the second wall.

9. The hose storage device of claim 1, wherein in the operative position, the handle protrudes from an exterior surface of the second wall.

10. A hose assembly, comprising:

a hose; and a hose storage device including:

an open cylindrical core having an outer circumference and an inner circumference, the inner circumference including an inner track;

a retention mechanism configured to receive and releasably secure an end portion of the hose to the outer circumference of the open cylindrical core;

a rotating ring operatively coupled to the inner track configured to rotatably move along the inner track relative to the inner circumference; and a handle pivotably coupled to the hose storage device and disposed between two protrusions extending from the outer circumference of the open cylindrical core along a same plane as an exterior surface of the hose storage device, the handle configured to pivot between an operative position and a storage position, wherein in the storage position, an end of the handle is flush with the exterior surface of the hose storage device such that the handle does not protrude beyond the exterior surface of the hose storage device.

11. The hose assembly of claim 10, wherein a length of the hose includes a flexible metal.

12. The hose assembly of claim 10, wherein the handle is coupled to the hose storage device via a hinge.

13. The hose assembly of claim 10, wherein the handle is configured to releasably lock in the operative position and the storage position.

14. The hose assembly of claim 10, wherein in the operative position, the handle protrudes from an exterior surface of the hose storage device.

15. The hose assembly of claim 10, wherein the handle is disposed adjacent to an outer circumference of the hose storage device.

16. The hose assembly of claim 10, wherein the retention mechanism includes a protrusion extending from the hose storage device.

17. The hose assembly of claim 10, wherein the hose storage device includes feet.

* * * * *